US008596962B1

(12) United States Patent
Liang

(10) Patent No.: US 8,596,962 B1
(45) Date of Patent: Dec. 3, 2013

(54) BOAS SEGMENT FOR A TURBINE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 464 days.

(21) Appl. No.: 13/052,325

(22) Filed: Mar. 21, 2011

(51) Int. Cl.
*F04D 29/58* (2006.01)

(52) U.S. Cl.
USPC ..... 415/116; 415/173.1; 415/95

(58) Field of Classification Search
USPC ..... 415/173.1, 116, 175, 115, 173.3, 170.1, 415/178; 416/95, 96 R, 97 R; 60/766
See application file for complete search history.

(56) References Cited

U.S. PATENT DOCUMENTS

| | | | | |
|---|---|---|---|---|
| 7,621,719 | B2 * | 11/2009 | Lutjen et al. | 415/173.1 |
| 2006/0182622 | A1 | 8/2006 | Parker et al. | |
| 2007/0031240 | A1 * | 2/2007 | Nichols et al. | 415/115 |
| 2010/0080707 | A1 * | 4/2010 | Tholen | 416/179 |

* cited by examiner

*Primary Examiner* — Nathaniel Wiehe
*Assistant Examiner* — Eldon Brockman
(74) *Attorney, Agent, or Firm* — John Ryznic

(57) ABSTRACT

A BOAS segment for a turbine includes an impingement cavity with circular cooling air supply holes adjacent to a leading edge side of the cavity and is connected to main body axial cooling holes that open onto the trailing edge side of the BOAS segment. Cooling supply holes are located at the four corners of the impingement cavity and are connected to multiple cooling holes that open onto both edges of the segment in that corner. Thin metering cooling slots are positioned along the mate face sides in the cavity and are each connected to multiple cooling holes that discharge cooling air onto the mate face edges.

5 Claims, 5 Drawing Sheets

BOAS SEGMENT FOR A TURBINE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a Blade Outer Air Seal (BOAS) segment for a gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A Blade Outer Air Seal (BOAS) or ring segment is used to form a seal with tips of rotating blades. FIG. 1 shows a prior art BOAS 11 secured by forward and aft hooks to a forward isolation ring 16 and an aft isolation ring 12. The isolation rings 16 and 12 fit within annular grooves formed within a blade ring carrier 13. The BOAS is formed from segments that form an annular arrangement around the blade tips 17. A stator vane 18 is located forward of the blade 17.

Cooling air for the BOAS 11 is provided through cooling air supply holes 14 formed in the blade ring carrier 13 and flows into a chamber above an impingement tube 15 that has an arrangement of impingement cooling air holes spaced around to direct impingement cooling air onto a backside surface of the BOAS. The cooling air then flows through metering holes 19 spaced around the BOAS and into axial direction cooling air holes to provide convection cooling to the hot surface of the BOAS. The cooling air is then discharged out through exit holes 20 arranged along the aft mate face edge of the BOAS 11. FIG. 2 shows an isometric view from the mate face side with the axial cooling holes opening onto the edge.

BRIEF SUMMARY OF THE INVENTION

A BOAS for a gas turbine engine in which the BOAS includes a row of thin slots along the leading edge side and both mate face sides for a supply of cooling air. Straight cooling air holes are connected to the thin cooling air supply slots and open onto the edges of the BOAS to discharge cooling air for cooling and sealing purposes. A row of metering feed holes are positioned along the leading edge side of an impingement cavity and supply cooling air to main body axial cooling holes that include trip strips or helical ribs to enhance heat transfer coefficient along the holes and that open onto the trailing edge side edge of the BOAS. Circular shaped cooling air feed holes are located in each of the four corners of the BOAS in the impingement cavity and supply cooling air to cooling holes positioned on the corners of the BOAS.

DETAILED DESCRIPTION OF THE INVENTION

Figure 1:
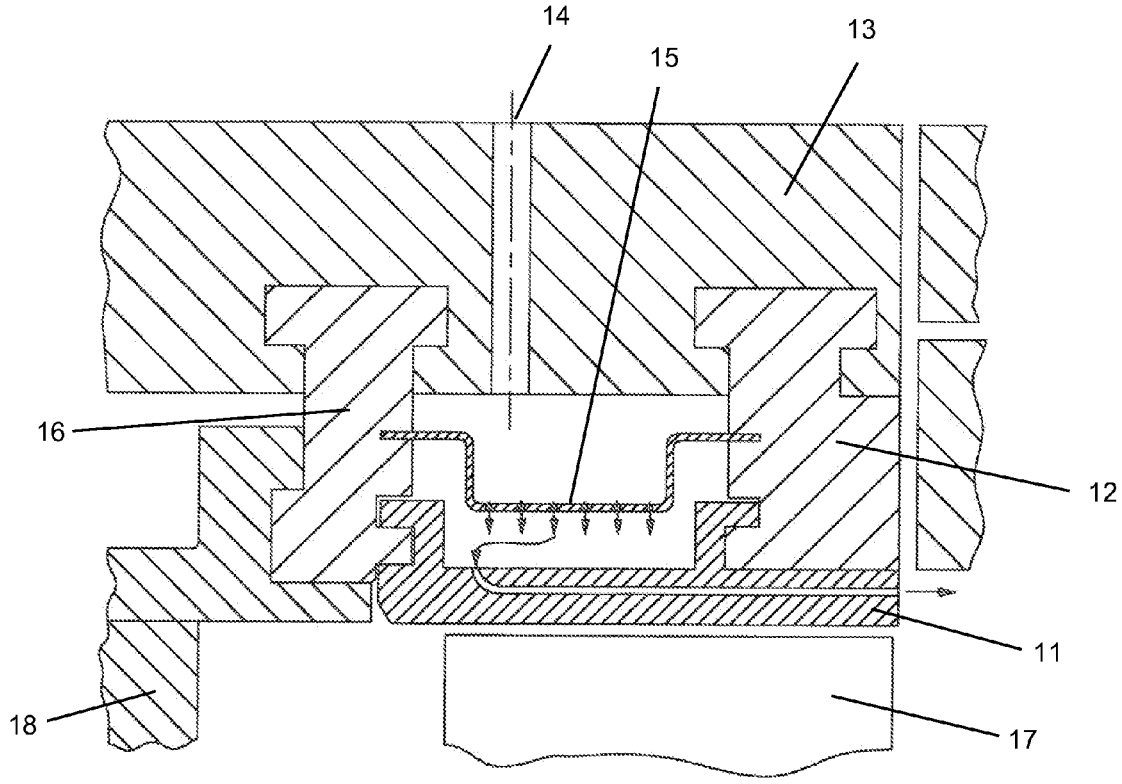
FIG 1 prior art
FIG. 1 shows a cross section view along a rotational direction of a blade of a prior art BOAS and blade ring carrier assembly.
Figure 2:
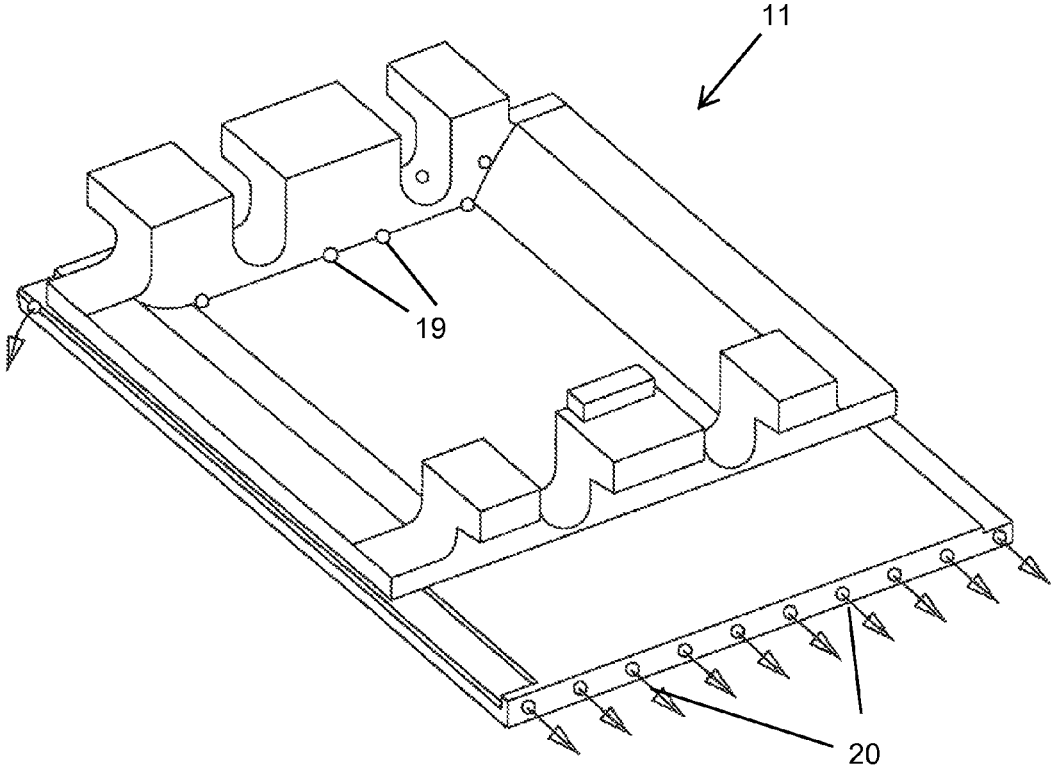
FIG 2 prior art
FIG. 2 shows an isometric view of a prior art BOAS with inlet metering holes and outlet discharge cooling holes.
Figure 3:
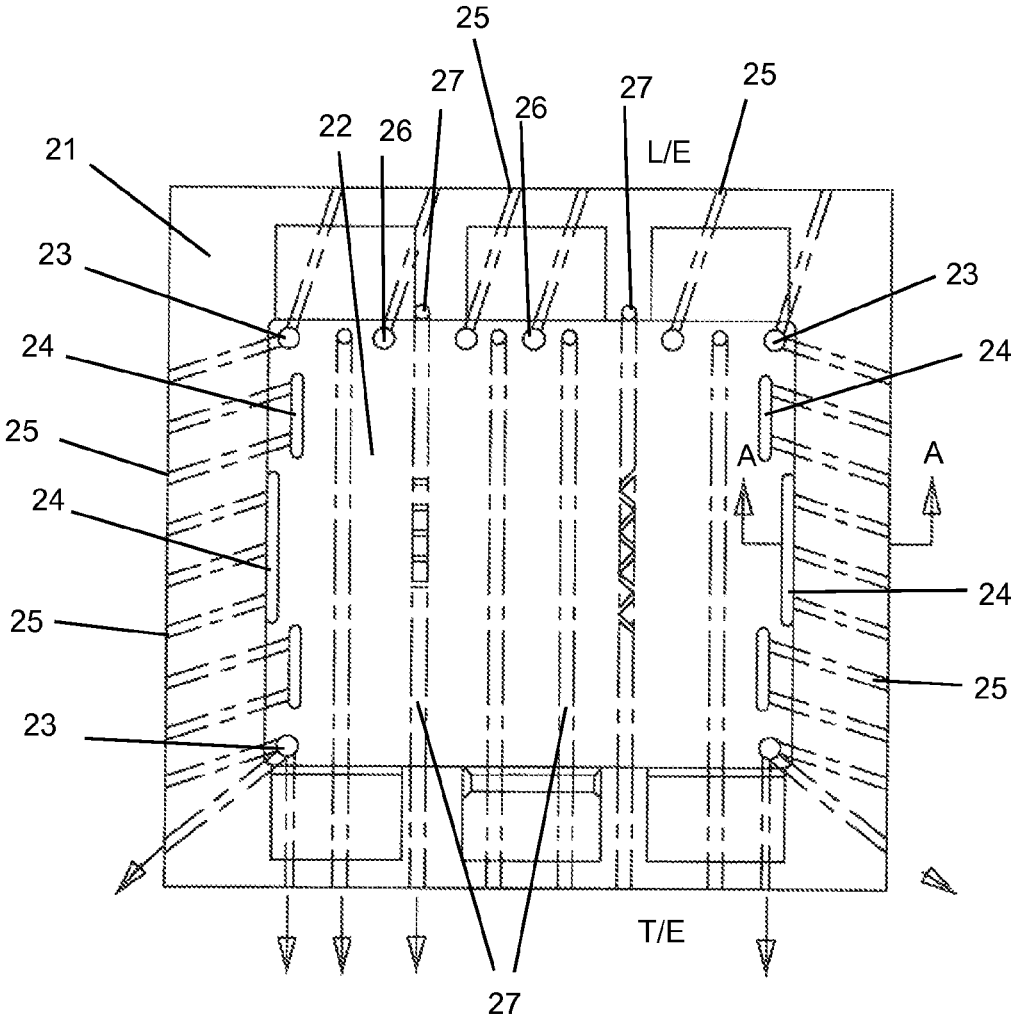
FIG. 3 shows a top view of a BOAS with a cooling flow circuit of the present invention.

The BOAS of the present invention is shown in FIG. 3 and includes a leading edge (L/E) side on the top of FIG. 3, a trailing edge (T/E) side, and two mate faces on the left and right sides in FIG. 3. An impingement cavity 22 is formed on the backside surface within the four sides of the BOAS 21. Four cooling air supply feed holes 23 are positioned in the four corners of the impingement cavity 22. These four feed holes 23 have a larger diameter than other metering supply holes because more than one cooling holes is connected to them.

A row of thin metering slots 24 are formed along the two mate face sides of the impingement cavity 22 and are each connected to multiple mate face cooling air holes 25 that are positioned on each of the two sides of the impingement cavity 22. The cooling holes 25 connected to the thin metering slots 24 open onto the mate face edges of the BOAS. In this embodiment, three thin metering slots 24 are formed on each of the two mate face sides of the impingement cavity 22.

A number of smaller metering holes 27 open on the BOAS top surface outside of the impingement cavity 22 and are connected to cooling holes 25 that open onto the L/E side of the BOAS to discharge cooling air.

As seen in FIG. 3, a row of metering feed holes 26 open into the impingement cavity 22 along the L/E side and are connected to BOAS main body axial cooling holes 27 that extend across the boas and open on the T/E side of the BOAS and discharge cooling air. The axial cooling holes 27 provide cooling to the hot surface of the BOAS below the impingement cavity 22 and are much longer than the mate face cooling holes 25. The main body axial cooling holes 27 can include trip strips (in the second hole from the left) or helical ribs (in the second hole from the right) to increase a heat transfer coefficient. In the embodiment in which trip strips are used in the main body axial cooling holes, the tripped cooling air that flows toward the T/E side will generate a new boundary layer within the cooling hole because of the trip strips. This multiple reattachment of the cooling air flow within the inner wall of the cooling hole creates a high rate of internal heat transfer coefficient and thus provides for a high cooling effectiveness for the BOAS main body cooling. In the embodiment with the helical rib, a vortex flow is created within the cooling hole with a high velocity. The higher velocity along the outer periphery of the cooling hole generates a high rate of internal heat transfer coefficient and thus provides for a high cooling effectiveness for the BOAS. Since each individual cooling air hole operates as an independent cooling air circuit, each cooling hole can be designed based on the local heat load around that cooling hole. The spent cooling air from the cooling holes is discharged out from the BOAS T/E side between a downstream located vane interface cavity to provide for additional film cooling for that vane or can be used as purge air for the cavity.

Figure 4:
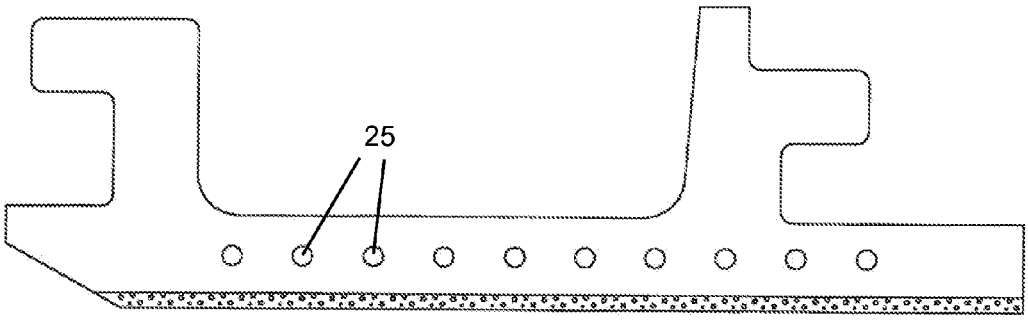
FIG. 4 shows a side view of the BOAS of FIG. 3 with mate face cooling holes opening onto the edge.

FIG. 4 shows a side view of the BOAS looking at one of the mate face sides. A TBC is applied on the bottom surface. The front hook and the aft hook are shown with the impingement cavity located between the two hooks. A row of mate face cooling holes 25 opens onto the edge.

Figure 5:
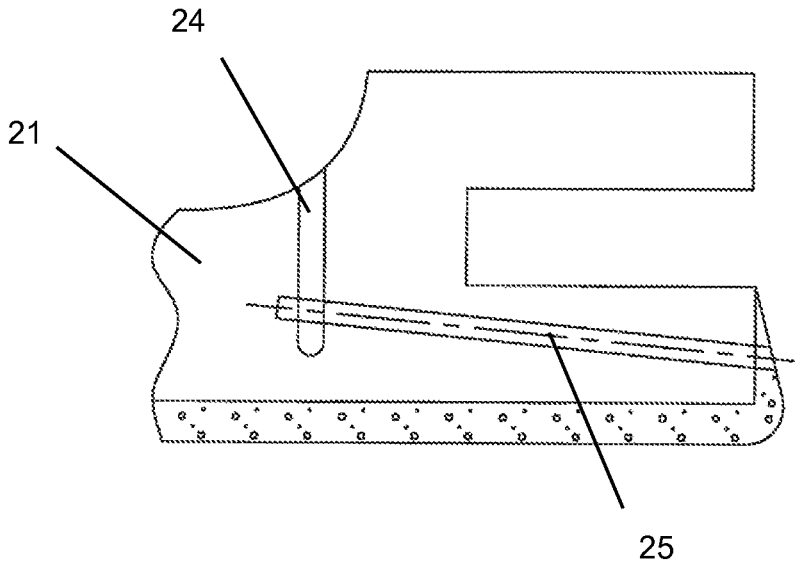
FIG. 5 shows a detailed view of a cross section through one of the thin metering cooling air slots and mate face cooling hole through line A-A in FIG. 3.

FIG. 5 shows a cross section view of one of the thin metering feed slots and the cooling hole along line A-A in FIG. 3. The thin metering feed slot 24 opens into the impingement cavity to supply cooling air to a plurality of mate face cooling holes 25. The thin metering feed slot 24 is about at a 90 degree angle to the cooling hole 25 so that impingement cooling of the BOAS hot side will occur. The thin metering slot 24 supplies cooling air to more than one mate face cooling hole 25.

A portion of the spent impingement cooling air is fed through a series of peripheral thin metering slots or holes to provide BOSAS L/E and mate face multiple channel or cooling hole cooling. The circular cooling supply holes are located around the BOAS L/E and T/E corners while the thin metering slots are staggered along the mate face sides to provide cooling for the mate face surfaces of the BOAS. Multiple cooling holes are connected to each thin metering slot or the corner holes for cooling the mate faces and the L/E and the corners between these three sections.

The multiple peripheral cooling slots can be constructed in a small module formation. Individual modules are designed based on the pressure gradient across the BOAS mate face gap. In addition, each individual module can also be designed based on the BOAS mate face local external heat load to achieve a desired local metal temperature. For example, two different thin metering slots and circular feed channel modules are used in the above described embodiment. In the forward section of the BOAS, due to the low available cooling pressure potential, a larger feed channel is used. Higher pressure gradient is available for the aft portion of the BOAS, and a smaller feed hole or a thinner slot with multiple cooling holes can be used. In addition to the cooling improvements, the multiple metered cooling channels design provides for an excellent cooling flow metering capability for the BOAS. The cooling air is metered first through the impingement ring and then metered again at the entrance to the BOAS cooling channels.

I claim the following:

1. A blade outer air seal segment for a turbine in a gas turbine engine, the blade outer air seal segment comprising:

a leading edge side and a trailing edge side with two mate face sides in-between;

an impingement cavity on a backside surface of the blade outer air seal segment;

a first cooling air supply hole located on each of the four corners of the impingement cavity;

each of the first cooling air supply holes being connected to at least two cooling holes that open onto two sides of the blade outer air seal to discharge cooling air;

a plurality of thin metering slots opening into the impingement cavity and adjacent to each of the two mate face sides;

each of the thin metering slots being connected to a plurality of cooling holes that open onto the adjacent mate face side of the blade outer air seal segment;

a row of second cooling air supply holes opening into the impingement cavity adjacent to the leading edge side of the cavity; and, each of the second cooling air holes is connected to a cooling hole that extends across the blade outer air seal main body and opens onto the trailing edge side of the blade outer air seal to discharge cooling air.

2. The blade outer air seal segment of claim 1, and further comprising:

a row of third cooling air supply holes opening into the impingement cavity adjacent to the leading edge side of the cavity; and, a cooling air hole connected to each of the third cooling air supply holes and opening onto the leading edge side of the blade outer air seal segment to discharge cooling air.

3. The blade outer air seal segment of claim 2, and further comprising:

the second cooling air supply holes alternate between the third cooling air supply holes.

4. The blade outer air seal segment of claim 1, and further comprising:

the cooling holes connected to the second cooling air supply holes include trip strips or helical ribs that increase a heat transfer coefficient for the cooling hole.

5. The blade outer air seal segment of claim 1, and further comprising:

the cooling air supply holes and thin metering slots are angled at around 90 degrees from the cooling holes that discharge onto the blade outer air seal segment edges.

* * * * *